United States Patent [19]

Raney

[11] Patent Number: 4,842,083

[45] Date of Patent: Jun. 27, 1989

[54] DRILL BIT STABILIZER

[76] Inventor: Richard C. Raney, 3609 Godfrey Ct., Midland, Tex. 79707

[21] Appl. No.: 76,920

[22] Filed: Jul. 23, 1987

Related U.S. Application Data

[63] Continuation-in-part of Ser. No. 820,742, Jan. 22, 1986, Pat. No. 4,690,229.

[51] Int. Cl.[4] ..... E21B 10/62; E21B 17/10

[52] U.S. Cl. ..... 175/325; 175/408

[58] Field of Search ..... 175/325, 393, 399, 408, 175/230

[56] References Cited

U.S. PATENT DOCUMENTS

| | | | |
|---|---|---|---|
| 1,738,860 | 12/1929 | Wigle | 175/399 |
| 3,051,255 | 8/1962 | Deely | 175/325 |
| 3,123,163 | 3/1964 | Rowley | 175/325 |
| 3,180,436 | 4/1965 | Kellner et al. | 175/325 |
| 4,270,619 | 6/1981 | Base | 175/325 |
| 4,388,974 | 6/1983 | Jones, Jr. et al. | 175/325 |
| 4,681,160 | 7/1987 | Fineberg | 175/325 |
| 4,690,229 | 9/1987 | Raney | 175/325 |
| 4,693,328 | 9/1987 | Furse et al. | 175/325 |

FOREIGN PATENT DOCUMENTS

| | | | |
|---|---|---|---|
| 0481690 | 5/1978 | U.S.S.R. | 175/408 |
| 0751956 | 7/1980 | U.S.S.R. | 175/325 |

*Primary Examiner*—Jerome W. Massie
*Assistant Examiner*—TerryLee Melius
*Attorney, Agent, or Firm*—Richard C. Raney

[57] ABSTRACT

A stabilizer for driving and radially stabilizing a drill bit. The stabilizer has a fluid passage therethrough for passage of drilling fluid to the drill bit. The stabilizer includes radially extendable wedge-like members for stabilizing abutment thereof with a borehole wall; means affected by drilling fluid pressure or spring tension for controlling extension and retraction of the wedge-like members; and, inclined slide surfaces for frictional interaction with the wedge-like members to prevent radial movement of said stabilizer relative to a borehole.

25 Claims, 8 Drawing Sheets

DRILL BIT STABILIZER

REFERENCE TO RELATED PATENT APPLICATION

This patent application is a continuation in part of patent application Ser. No. 06/820,742, filed Jan. 22, 1986 now U.S. Pat. No. 4,690,229.

BACKGROUND OF THE INVENTION

The present invention pertains to an assembly or device for radially stabilizing a drill string which includes rotating tubular bodies such as oil field drill bits, drill collars, and the like which tend to radially vibrate or whip during operation.

In the operation of each embodiment of the present invention, as in the operation of prior art devices, the assembly is rotated in a borehole as in drilling an oil or gas well, and drilling fluid is pumped in the usual manner downward through a central axial passage formed through the assembly. The drilling fluid returns upward through the borehole annulus on the outside of the assembly. As in normal practice, the diameter of the borehole is only slightly larger than the assembly, providing only sufficient running clearance for free rotation of the assembly.

However, in the operation of prior art devices, the running clearance increases due to wear of the outside of the drill string. Since the degree of whip or radial vibration of a drill string increases as the running clearance increases, harmful vibration or whip occurs with prior art devices. As will be shown in the following explanation, the present invention provides means to prevent excessive running clearance and thus will prevent whip or radial vibration of a drill string.

SUMMARY OF THE INVENTION

A drill bit stabilizer having a main body of generally cylindrical configuration and a pin end opposed to a lower drill end. The lower drilling end is attachable to a drill bit for driving the drill bit when the drill bit is rotating and making hole. A throat is formed longitudinally through the main body of the stabilizer for passage of drilling fluid from a drilling string, through the body, and through the drill bit. The drilling fluid exits the bit and returns up the borehole annulus.

A plurality of circumferentially arranged slots are formed about the main body from the outer surface of the body inward to slidably receive corresponding wedge shaped stabilizing members. Means are provided by which the stabilizing members are hydraulically or spring actuated. The stabilizing members are therefore reciprocatingly received in a slidable manner as they are hydraulically or spring actuated within the slots. Each of the stabilizing members has an outer face which is retracted into alignment with the outer surface of the main body, and which can be extended outwardly from the surface of the body and into abutment with the wall of a borehole.

The before mentioned hydraulic or spring means are incorporated into the main body in a manner such that each of the stabilizing members are forced to move concurrently in an angular direction downwardly and outwardly of the main body when the hydrostatic pressure differential between the throat and the borehole annulus reaches a minimum value. The hydraulic or spring means maintains the stabilizing members in the extended configuration, and as the face of the stabilizer member is worn, the face of the member is further extended into abutment with the borehole wall. Means is provided to enable retraction of the stabilizing members respective to the borehole wall surface when desired.

Frictional means is provided to lock or block the stabilizing members in any one of a range of extended positions. The frictional means is the friction between the sliding surfaces of the wedge shaped stabilizing members and the slots within which the wedges are received.

One object of the present invention is to provide a drill bit stabilizer that brings about a substantially increased drill bit operating life with equal or greater drilling penetration rate than prior art drill bits.

Another object of this invention is the provision of a drill bit stabilizer that brings about the capability of drilling more predictably and economically through an extremely wide range of different rock and earth formations.

Still another object of this invention is to provide a drill bit stabilizer having reduced tendency to whip, or radially vibrate, during rotary operation.

Another and further object of this invention is to provide a drill bit stabilizer that is economical to manufacture.

An additional object of the invention is the provision of a rotary drill bit stabilizer having retractable stabilizing members arranged about the circumference thereof which can be extended into abutment with the borehole wall while driving a drill bit.

Another object of the invention is to provide a drill bit stabilizer which is equally effective in drilling with compressed air, normal drilling fluid, or reversed circulation.

Other objects and advantages of the present invention will be apparent upon consideration of the following specification, with reference to the accompanying drawings forming part thereof, and in which like numerals correspond to like parts throughout the several views of the invention.

DETAILED DESCRIPTION OF THE PREFERRED EMBODIMENTS

Figure 1:
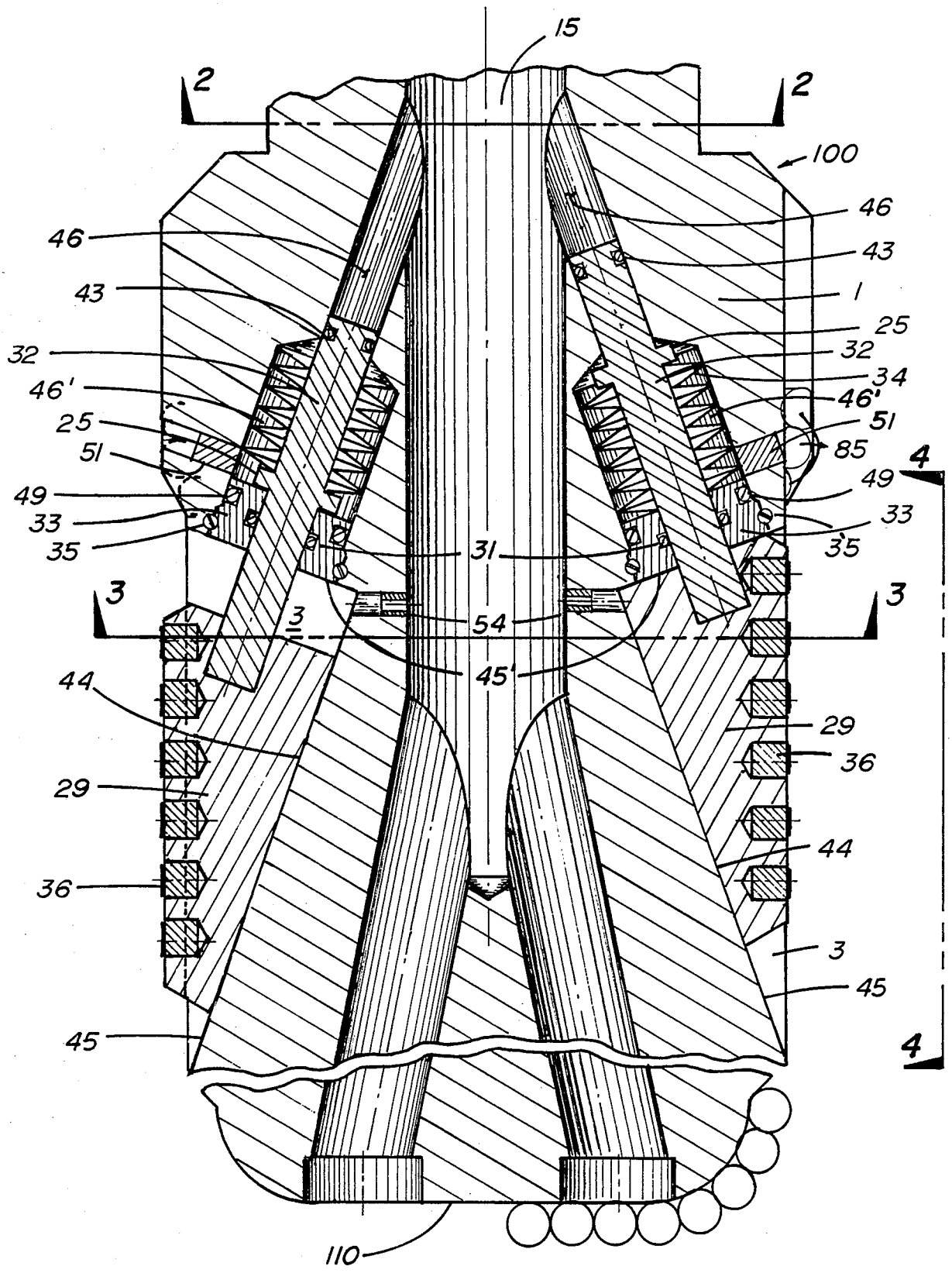
FIG. 1 is a longitudinal, sectional view of the preferred embodiment.

Referring to the figures of the drawings, and specifically to FIGS. 1, 2, 3, 4, and 13, the preferred embodiment comprises an improved drill bit stabilizer, generally indicated by the numeral 100. The stabilizer comprises a main body 1 made of a suitable material such as steel. The main body 1 is generally cylindrical in shape and the upper end thereof is threaded in the conventional manner or is otherwise provided with a known means for attachment to the end of a drill pipe or "drill string". The main body 1 has a central fluid passage or throat 15 extending from the top end, axially along the central axis towards the lower end. The lower marginal end of the main body 1 may be an integral part of a drill bit 110, as seen in FIG. 1, or it may be a separate member suitably attachable to a drill bit with the throat 15 arranged to provide a flow of drilling fluid therethrough to the drill bit, as described in my previous patent application Ser. No. 06/820,742 filed Jan. 22, 1986, of which this patent application is a continuation in part.

Figure 3:
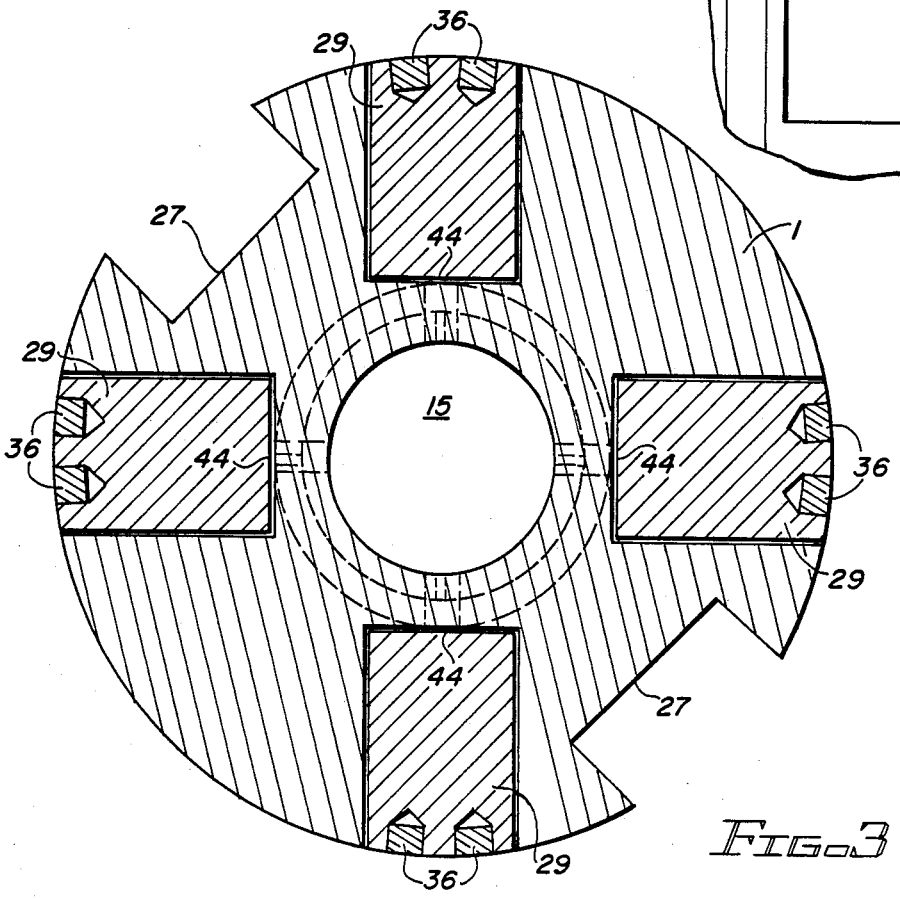
FIG. 3 is a cross-sectional view taken along line 3—3 of FIG. 1.

The preferred embodiment 100 includes a plurality of novel radial stabilizing wedges 29 installed in complementary radial slots 3 formed into the main body 1 in spaced relationship respective to the throat 15. The slots 3, with the respective wedges 29 installed therein, are symmetrically arranged circumferentially about the central longitudinal axis of the main body 1, as seen in FIGS. 1 and 3. The preferred embodiment 100 of FIGS. 1 and 3 include four such wedges 29, however, any suitable number may be employed.

The slots 3 are each shaped and arranged to provide a mated slide surface 45 which is inclined downward and outward relative to the central axis of the main body 1. The upper end surface 45' of each slot 3 is generally perpendicular to the inclined slide surface 45, as seen in FIG. 1. Each wedge 29 is correspondingly shaped and arranged so that the outer surface of each wedge 29 is flush or aligned with the outer surface of the main body 1 when the wedges 29 are fully seated into the slots 3. Each wedge 29 has an inner slide surface 44 which is mated to and arranged to slide against the slide surface 45.

The outer faces of the wedges 29 are provided with wear resistant tungsten carbide buttons 36 pressed into complimentary holes formed in the outer faces of the wedges 29, so that the wear resistant buttons 36 are flush or aligned with the outer face of the wedges 29, thereby making the outer faces of the wedges 29 wear resistant. The wedges 29 may alternatively be made entirely of a wear resistant material such as ceramic, or may be made wear resistant by other known expedients.

Corresponding plungers 32 are suitably fastened to the upper end of each wedge 29 and extend upward and inward parallel to the slide surface 45 of each slot 3. Complementary bores 46 which communicate with the throat 15 are provided to receive each plunger 32. Each bore 46 has an enlarged lower section to form a spring chamber 46' and to accommodate seal bushing 33. The seal bushings 33 are installed in fixed relationship within the lower marginal end of the spring chambers 46' and reciprocatingly receive the plunger 32 in sealed relationship therewith by means of the illustrated high pressure packings 31. The seal bushings 33 are sealed to the spring chambers 46' by o-rings 49 and are affixed therein by locking rings 35, or by other suitable known means. Springs 34, such as bellville washers, and preferably of the stacked disk type, are received about each plunger 32 between the seal bushing 33 and a shoulder 25 formed on the plunger 32 near the upper marginal end thereof. The springs 34 bias each of the plungers 32 towards the throat 15 or, alternatively, the springs 34 may be arranged to bias the plungers 32 outward, with the plungers to be retracted inward by other force means such as by thrust against the rim of the pilot hole formed by the bit face.

Seals 43 are provided at the upper marginal end of each plunger 32 which are thus reciprocatingly sealed respective to the bores 46. The springs 34 are thus respectively confined and sealed within the chambers 46' at a location between the upper seals 43 and the lower packings 31. The spring chambers 46' preferably should be filled with an incompressible fluid, such as hydraulic oil, which is sealed therein by plugs 51.

As seen in Flgure 1, the portion of the main body 1 immediately above the wedges 29 is slightly larger in diameter than the borehole produced by the drill bit 110 and has installed therein secondary gauge cutters 85. The secondary gauge cutters 85 are positioned and arranged to produce a borehole large enough in diameter for the entire assembly to pass upward therethrough even when the wedges 29 are fully extended. The drill bit 110 and the primary gauge cutters thereof thus forms a pilot hole which is intended to be enlarged by the secondary gauge cutters 85.

Figure 2:
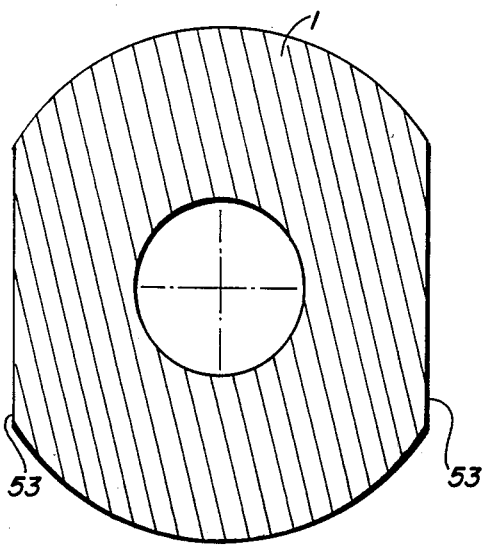
FIG. 2 is a cross-sectional view taken along line 2—2 of FIG. 1.
Figure 4:
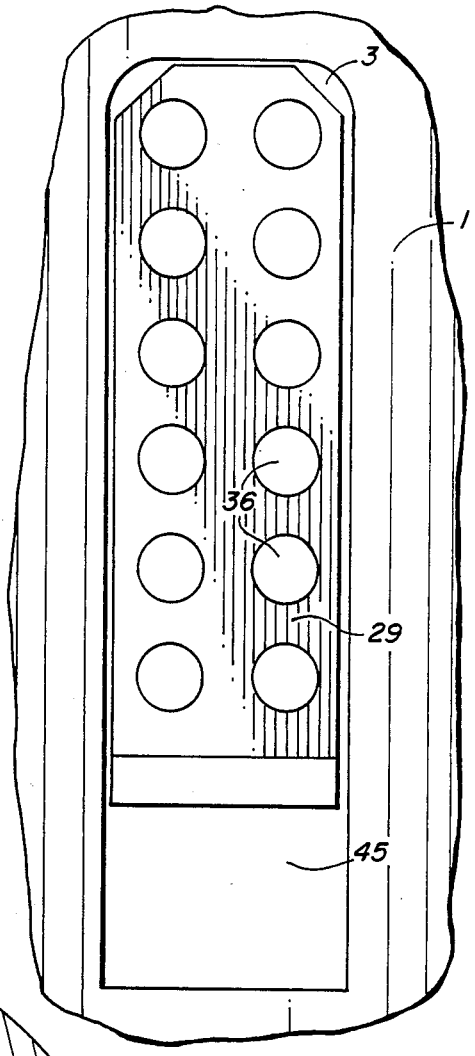
FIG. 4 is an enlarged, partial, side view taken along line 4—4 of FIG. 1.
Figure 13:
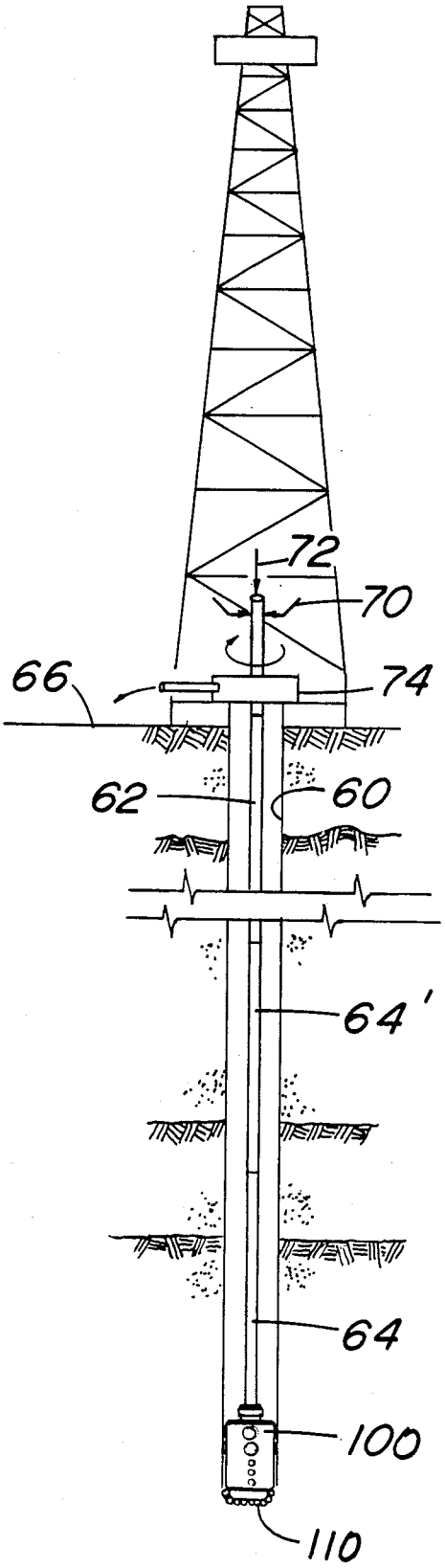

As seen in FIGS. 1 and 2, parallel wrench flats 53 are machined into opposite sides of the neck portion of the main body 1 in the conventional fashion to accommodate conventional tools for attaching or detaching the stabilizer 110 to a drill pipe 62, seen in FIG. 13.

As seen in FIG. 13, a borehole 60 has a drill string 62 and drill collar 64 therein, with the stabilizer 100 attached to the lower end thereof. A drill bit 110 is integrally attached to the lower end of the stabilizer 100. A drilling rig 70 manipulates the drill string 62.

The drill string 62, drill collar 64, together with the stabilizer 100 and drill bit 110 attached are inserted in a borehole 60 and rotated in the conventional manner during a drilling operation, as seen in FIG. 13.

In operation, drilling fluid flows at 72 into the drill string 62, through the drill string 62, through the throat 15 of the present stabilizer 100, out of the drill bit 110, back up the borehole annulus outside the drill string 62, and returned through a rotating blowout preventor 74 in the usual manner. As seen in FIG. 3, slots 27 are provided in the outside of the main body 1 to allow fluid to pass upward between the borehole and the main body 1.

In a usual operation, drilling fluid flowing through the present stabilizer 100 is at a relatively elevated pressure within the throat 15 because of the usual pressure drop measured across the drill bit 110. Therefore, fluid entering the throat at the upper ends of the bores 46 will exert a resultant downward and outward force upon the plungers 32. When the fluid pressure within the throat 15 and the bores 46 is sufficient in combination with the thrust of the springs 34, the plungers 32 will move downward due to the force differential. The wedges 29 will thus be caused to move downward and outward along the slide surface 45 until the outer face of the wedges 29 abuts the wall of the borehole. The wedges 29 are thus held in contact with the wall of the borehole so long as sufficient fluid pressure and/or spring tension is maintained. Also, as the outer surface of the wedges 29 slowly wear due to friction against the wall of the borehole, sufficient fluid pressure and/or spring tension will continually force the plunger 32 and the wedges downward and outward to maintain the outer face of the wedges 29 in constant rotating abutment with the stationary wall of the borehole.

In the above mode of operation, the wedge 29 will run in a pilot hole formed by the drill bit 110 and the primary gauge cutters thereof while the secondary gauge cutters 85 enlarge the borehole to the desired final diameter.

The angle of the slide surfaces 44 and 45, with respect to the axis of the main body 1, is of a selected value so that inward radial force exerted on the outer surface of each edge 29 produces sufficient friction between the mated slide surfaces 44 and 45 to overcome the resultant upward sliding vector force on the wedges 29, so that the wedges 29 cannot be forced to retract during the drilling operation. Tests indicate that any angle in the range of 15° to 20° is quite effective. The slide surfaces 44 and 45 may also be conditioned by adding abrasive particles thereto, or by other known means, so as to endow the coacting slidable surfaces with relatively high frictional characteristics. Thus, the relative angle and arrangement of the slide surfaces 44 and 45 is such to block any radial inward movement of the wedges 29 at any extended position thereof when an inward radial force is exerted on the wedges 29. This is so even if such inward radial force is of a magnitude that would be sufficient to overcome or displace the fluid pressure within the throat 15, and/or spring tension, in the absence of the frictional interaction of the slide surfaces 44 and 45.

Thus, the present invention provides means by which a drill bit is prevented from radially vibrating or whipping. The drill bit 110 is positioned where it is protected from impact damage and from the premature failure which may otherwise result therefrom in the absence of this invention.

In the case of normal fluid circulation, reduced circulation of drilling fluid reduces the pressure drop of the drilling fluid flowing through the bit 110, and the fluid pressure within the throat 15 is therefore reduced until it becomes equalized with respect to the fluid pressure on the outside of the main body 1. Thus, in this condition, no outward or downward hydraulic force is exerted against the plungers 32 and the thrust of the springs 34 may be arranged to therefore force the plunger 32 and the wedges 29 upward and inward along the slide surface 45. Thus, the wedges 29 can be selectively caused to retract inward by reducing the fluid pressure within the throat 15. Alternatively, other force means such as abutment of the wedges 29 with the rim of the pilot hole formed by the drill bit 110 during downward movement of the assembly may be used to cause retraction of the wedges 29 and plungers 32. Moreover, because of the borehole diameter produced by the secondary gauge cutters 85, the wedges 29 need not be retracted in order for the assembly to be withdrawn upward from the borehole. This novel arrangement of the secondary gauge cutters and wedges therefore provides new and novel results.

As seen in FIGS. 1 and 3, flushing orifices 54 are positioned to provide fluid communication between the throat 15 and the slots 3 and are sized and arranged to provide an effectual flow of fluid through the slots 3 so as to prevent detritus material from packing or jamming around the coacting surfaces of the wedges 29.

The main body 1 and the holes and passages therein, the wedges 29, plunger 32, and the seal bushings 33 all can be readially fabricated by conventional methods such as machining or molding. The seals 31 and 43, wear resistant buttons 36, springs 34, o-rings 49, and the orifices 54 all are readily available commercial products which can be installed in the stabilizer of the present invention. Thus, the present invention can be readily and economically manufactured.

BRIEF DESCRIPTION OF THE SECOND EMBODIMENT

Specifically referring to FIGS. 5, 6, 7, 8, and 13, the second embodiment is intended to be built into a tubular main body 1 having a central fluid passage or throat 15 extending axially therethrough. In the usual operation of such tubular bodies, such as in drilling an oil well, the body 1 is rotated within a borehole while drilling fluid is pumped in the usual manner downward through the central throat 15 and is returned upward through the borehole annulus located on the outside of the body 1, and through axial flow slots 27 formed in the outside of the body 1.

Figure 5:
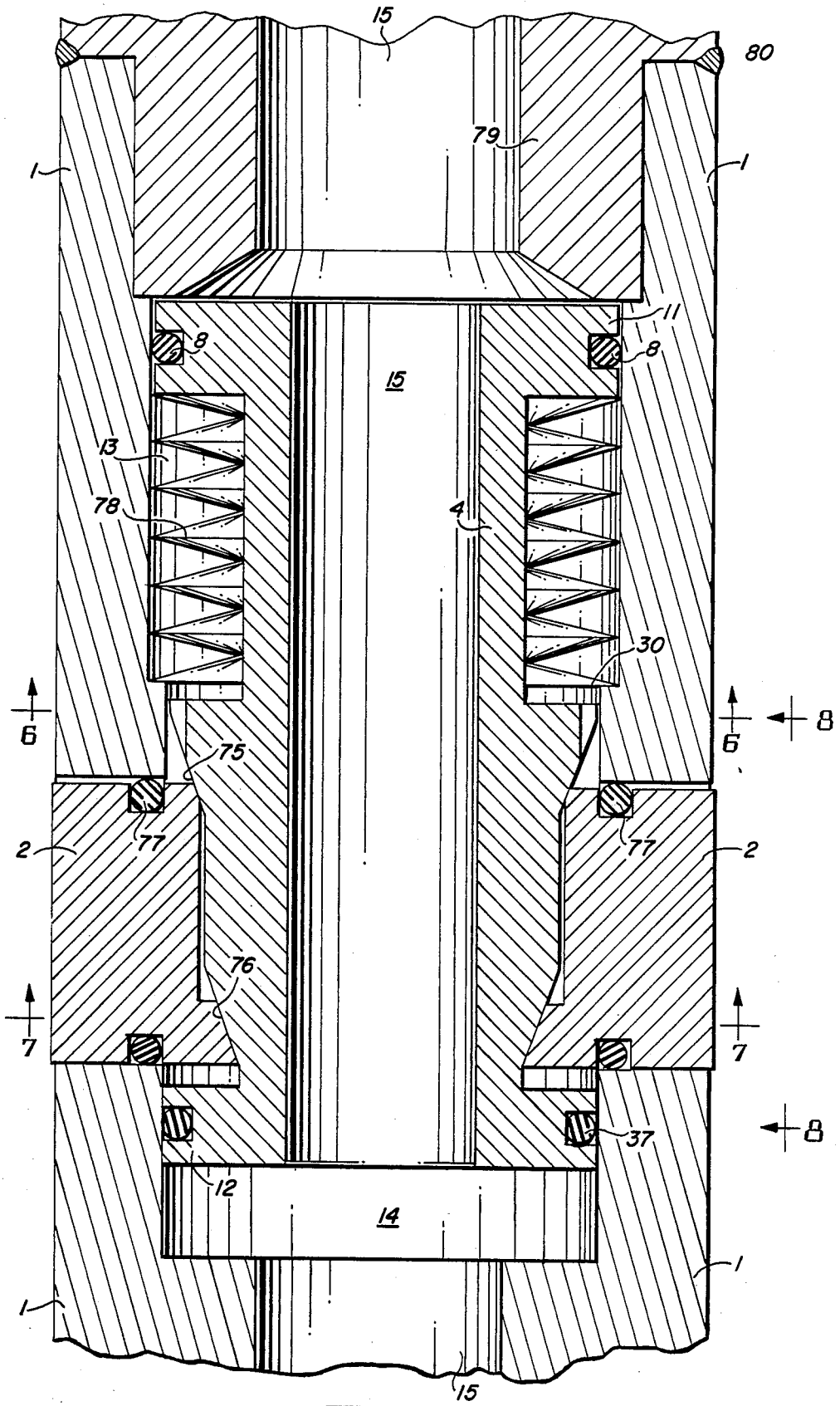
FIG. 5 is a broken, longitudinal, sectional view of a second embodiment of the invention.
Figure 6:
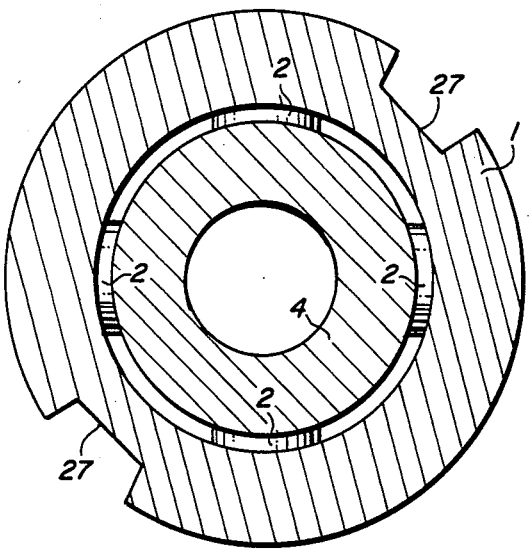
FIG. 6 is a reduced, cross-sectional view taken along line 6—6 of FIG. 5.
Figure 7:
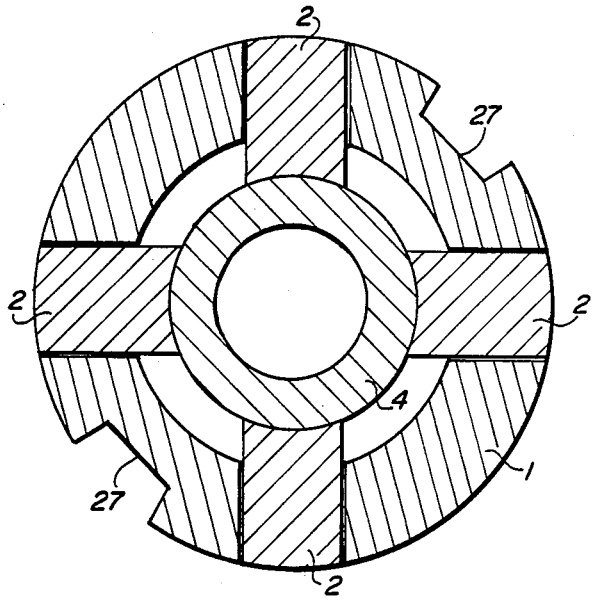
FIG. 7 is a reduced, cross-sectional view taken along line 7—7 of FIG. 5.
Figure 8:
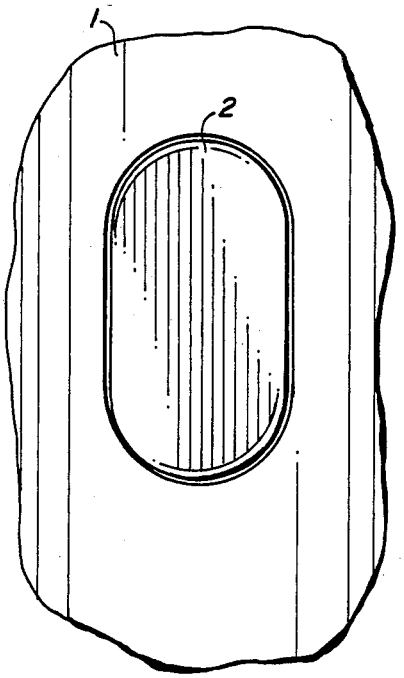
FIG. 8 is a fragmentary, side view taken along line 8—8 of FIG. 5.

In FIG. 5, the second embodiment comprises a plurality of radially movable wedge-like shoes 2 disposed within complementary mounting holes formed through the sides of the main body 1. An annular central control plunger 4 is arranged axially within the body 1. The control plunger 4 has spaced apart conical slide surfaces 75 and 76 formed thereon which are positioned and arranged to abut mating slide surfaces formed on the inner wall surface of each wedge-like shoe 2. The shoes 2 are arranged to rest in a retracted inward position against the respective slide surfaces 75 and 76. The shoes 2 are elliptical or oblong in shape, as shown in FIG. 8, in order to prevent their rotation within their corresponding mounting holes, and are reciprocatingly sealed in a slidable manner respective to the mounting holes by o-rings 77.

A minor piston 12 is formed on the lower marginal end of the plunger 4 and is reciprocatingly received in sealed relationship within the axial bore 14 by means of o-rings 37. The axial bore 14 is formed along the central axis within the body 1. A major piston 11 is formed on the upper marginal end of the plunger 4 and is reciprocatingly sealed respective to a complementary axial bore 13 by means of o-ring 8. The axial bores 13 and 14 intersect at a position slightly above the rest position of the upper conical surface 75 to form a stationary shoulder 30. The plunger and bore 13 form a spring containing chamber between the shoulder 30 and the major piston 11. A plurality of springs 78 are positioned within the chamber between the major piston 11 of the plunger 44 and the shoulder 40 of the body 1. The springs 78 are preferably the stacked disk type such as Bellville washers and are arranged to provide effectual upward thrust against the major piston 11 and thus impart upward movement into the entire plunger 4.

A driving member 79 is integrally connected to the upper end of the body 1 by conventional means such as threading, or by press fitting and welding at 80 as shown. The driving member may be alternatively connected by a variety of other known methods.

The lower end of the body 1 may be suitably connected to a drill pipe, drill collar, or to a drill bit, or it may be suitably formed to function as a drill bit (not shown).

The annular chamber formed between the major piston 11 and the minor piston 12 and radially between the o-rings 77 and the plunger 4 is in effect a sealed but movable chamber which is preferably filled with an incompressible fluid such as hydraulic oil.

The angle of the slide surfaces 75 and 76 is of a selected value wherein an inward radial force effected on the shoes 2 produces sliding friction on the slide surfaces 75 and 76 that exceeds the resultant sliding vector force so that an inward radial force on shoes z will not force the plunger 4 to move upwards.

The slide surfaces 75 and 76, and the shoes 2 are sized and arranged so that the outer faces of the shoes 2 are flush with the outer surface of the body 1 when the plunger 4 is in its upper rest position. The shoes 3 are cammed outward by the slide surfaces 75 and 76 as the plunger 4 moves downward.

The differential diameters of the pistons 11 and 12 are sized so that the effective displacement of the pistons 11 and 12, as the plunger 4 moves downward, equal the displacement of the shoes 2 as they are cammed outward by the slide surfaces 75 and 76, so that the annular chamber formed between pistons 11 and 12 within the apparatus does not effectively change in volume.

In operation, the drilling fluid passing downward through the central passage 15 is at an elevated pressure relative to the fluid pressure on the outside of the body 1 due to the usual flow restriction found in a drill bit (not shown) attached below the body 1. Also, the strength of the springs 78, the effective displacement of the pistons 11 and 12, and the effective displacement of the shoes 2 are all matched and balanced against the fluid pressure so that normal fluid pressure causes the plunger 4 to move downward, overcoming the springs 78 and camming the shoes 2 outward into abutment with the borehole wall. Further, as the outer faces of the shoes 2 gradually wear due to friction against the borehole, the shoes 2 are progressively cammed outward to remain in continual abutment with the borehole wall. Furthermore, due to the angle of the slide surfaces 75 and 76, and due to the resultant frictional contact between the slide surfaces 75 and 76 and the mating surfaces of the shoes 2, radial pulsations or shick loads cannot cause the shoes 2 to move inward relative to the body 1 so long as sufficient fluid pressure is maintained. Thus, radial vibration or whip of the body 1 is prevented.

Whenever the flow of drilling fluid is stopped and fluid pressure is thereby removed from the pistons 11 and 12, the plunger 4 will return fully upward in response to the force of the return springs 78. Because of the matched displacement of the pistons 11 and 12 and the shoes 2, the shoes 2 will be forced inward by low fluid pressure differential.

BRIEF DESCRIPTION OF THE THIRD EMBODIMENT

Figure 12:
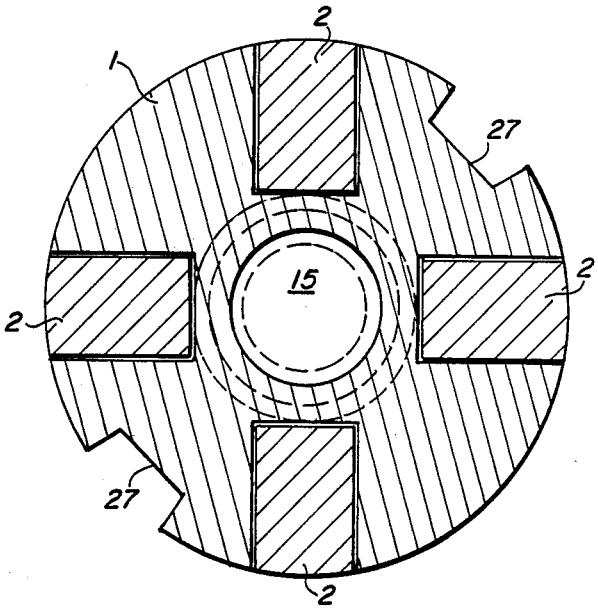
FIG. 12 is a cross-sectional view taken along line 12—12 common to FIGS. 9, 10, and 11; and, FIG. 13 is a diagrammatical, part cross-sectional view of a drilling operation with the present invention schematically illustrated therewith.
Figure 9:
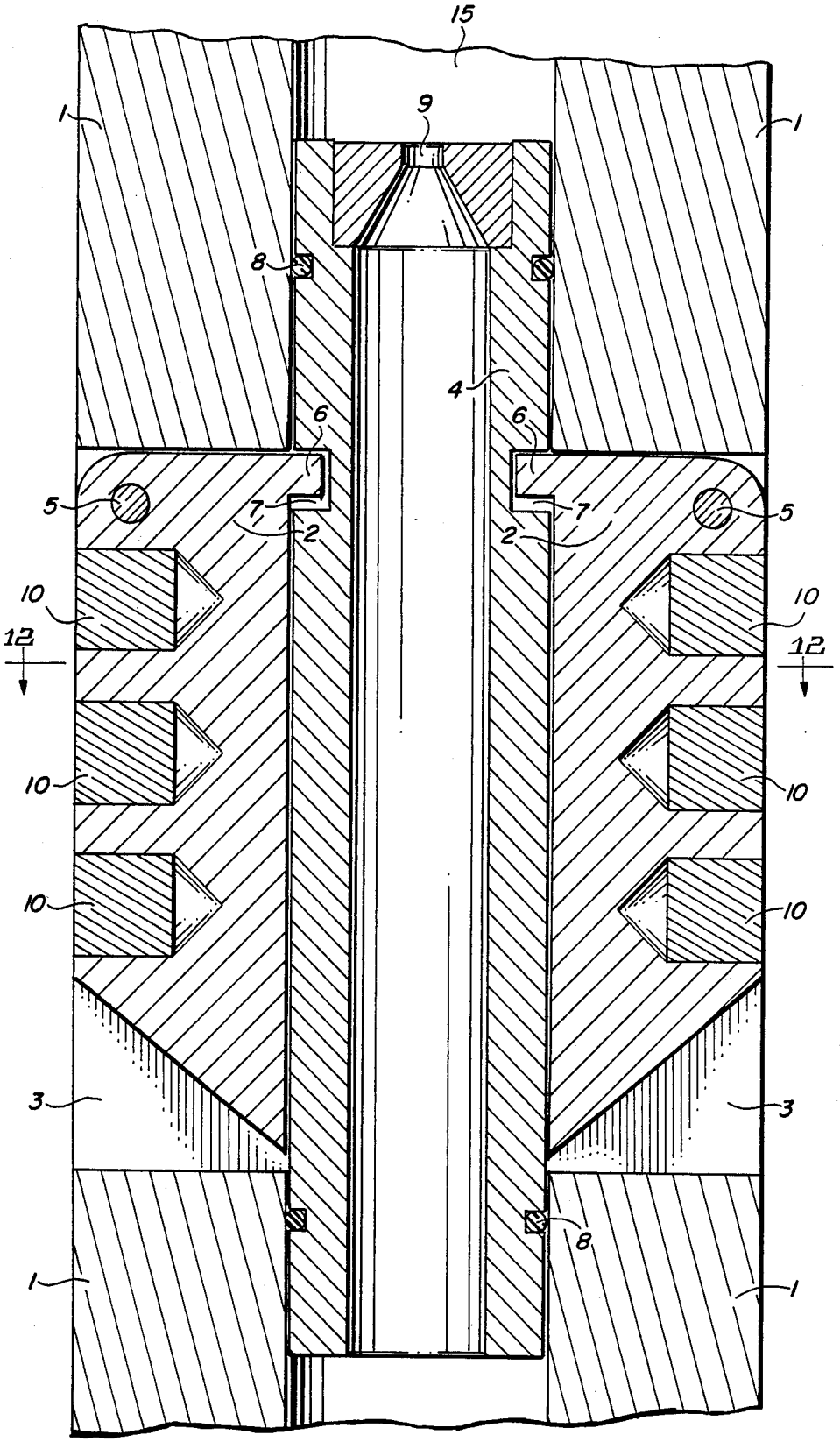
FIG. 9 is a longitudinal, sectional view of a third embodiment of the invention.

Specifically referring to FIGS. 9 and 12 of the drawings, the third embodiment comprises a plurality of radially movable shoes 2 disposed within the illustrated corresponding slots 3. The slots extend through the side of the body 1 and a central control plunger 4 is reciprocatingly received within the axial bore 15 of the body 1. Each of the shoes 2 is retained in position by a pivot 5 which permits the shoes 2 to swing radially outward relative to the body 1. Each of the shoes 2 include an engagement tab 6 which engage an annular groove 7 formed on the outside surface of the plunger 4. This enables the shoes 2 to swing outward in a synchronous manner as the plunger 4 moves axially downward, and inward as the plunger 4 moves axially upward. The outward travel of the shoes 2 is limited by abutment with the borehole, or by appropriate stop means, not shown. When the shoes 2 are bottomed inwardly against the plunger 4, the outer surfaces of the shoes 2 are generally flush with the outside of the body 1. The plunger 4 is of sufficient length to bridge across the length of the radial slots 3 and is slidably sealed at each opposed end to the inner axial bore 15 of the body 1 by o-rings 8. An orifice 9 is affixed within the plunger 4, preferably at the upper end thereof, so that an effectual pressure drop and resultant downward force is provided whenever fluid is pumped downward therethrough. The orifice 9 is preferably of an abrasion resistant material such as tungsten carbide.

In the operation of the embodiment of FIG. 9, the resultant downward force on the plunger 4 will cause the shoes 2 to swing outward and abut against the wall of the borehole. The engagement of the tabs 6 with the common groove 7 will provide synchronous movement and force of the shoes 2 and thus will prevent radial vibration or whip of the body 1 when sufficient downward force is exerted on the plunger 4. The shoes 2 will therefore remain in abutment with respect to the wall of the borehole, even when wear occurs therebetween. The shoes 2 can be retracted inwardly by stopping the fluid flow.

BRIEF DESCRIPTION OF THE FOURTH EMBODIMENT

Figure 10:
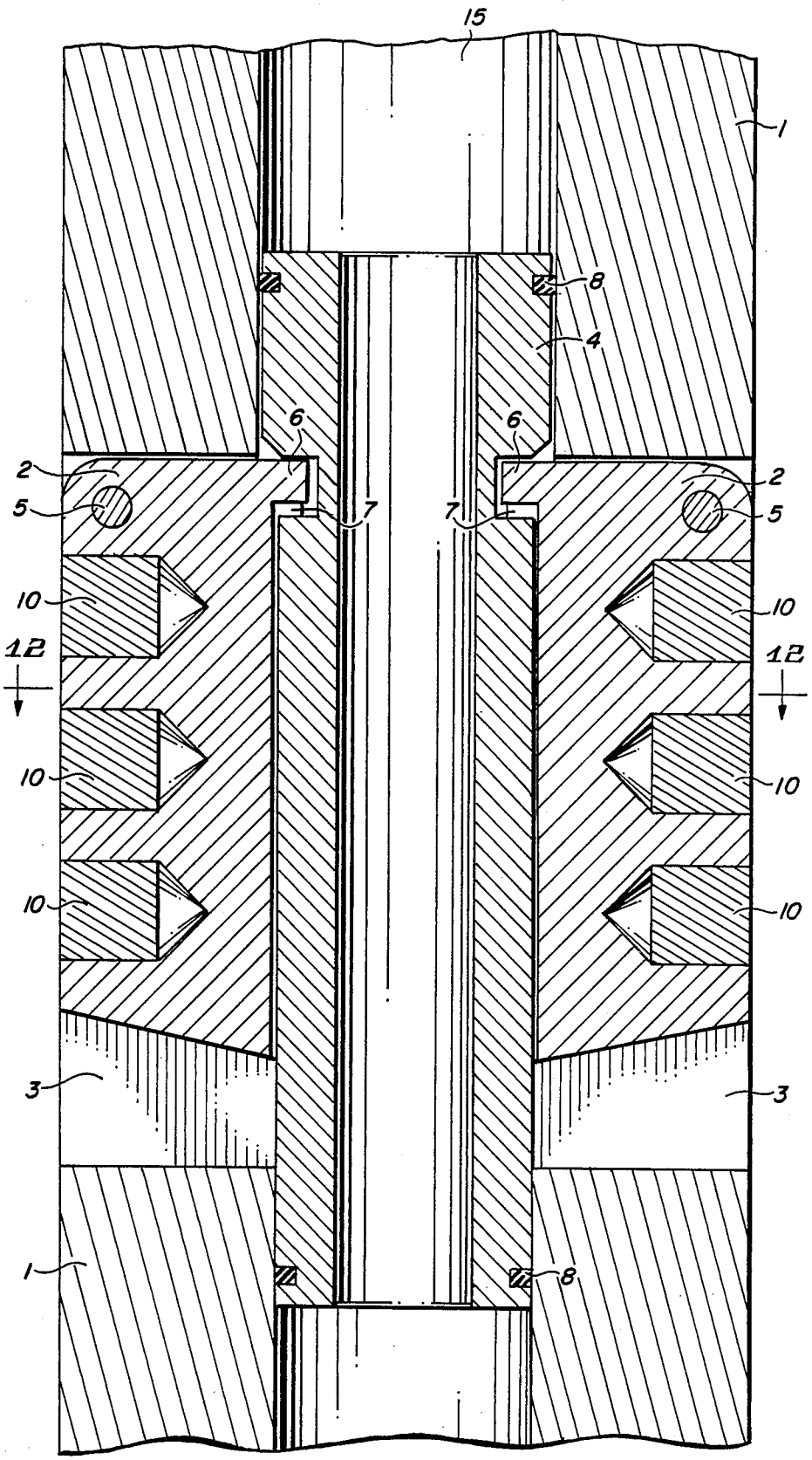
FIG. 10 is a longitudinal, sectional view of a fourth embodiment of the invention.

Specifically referring to FIGS. 10 and 12 of the drawings, the fourth embodiment is similar to the third embodiment except that in FIG. 10 the upper sealed end of the plunger 4 has a larger diameter than the lower sealed end. Thus, pressurized fluid within the axial bore 15 of the body 1 will force the plunger 4 downward due to the differential diameters of the plunger. In this embodiment, the orifice 9 of FIG. 9 is omitted. In the operation of the embodiment of FIG. 10, the fluid is pressurized by back pressure from an orifice or restriction at some point below the plunger 4, such as in a drill bit (not shown).

BRIEF DESCRIPTION OF THE FIFTH EMBODIMENT

Figure 11:
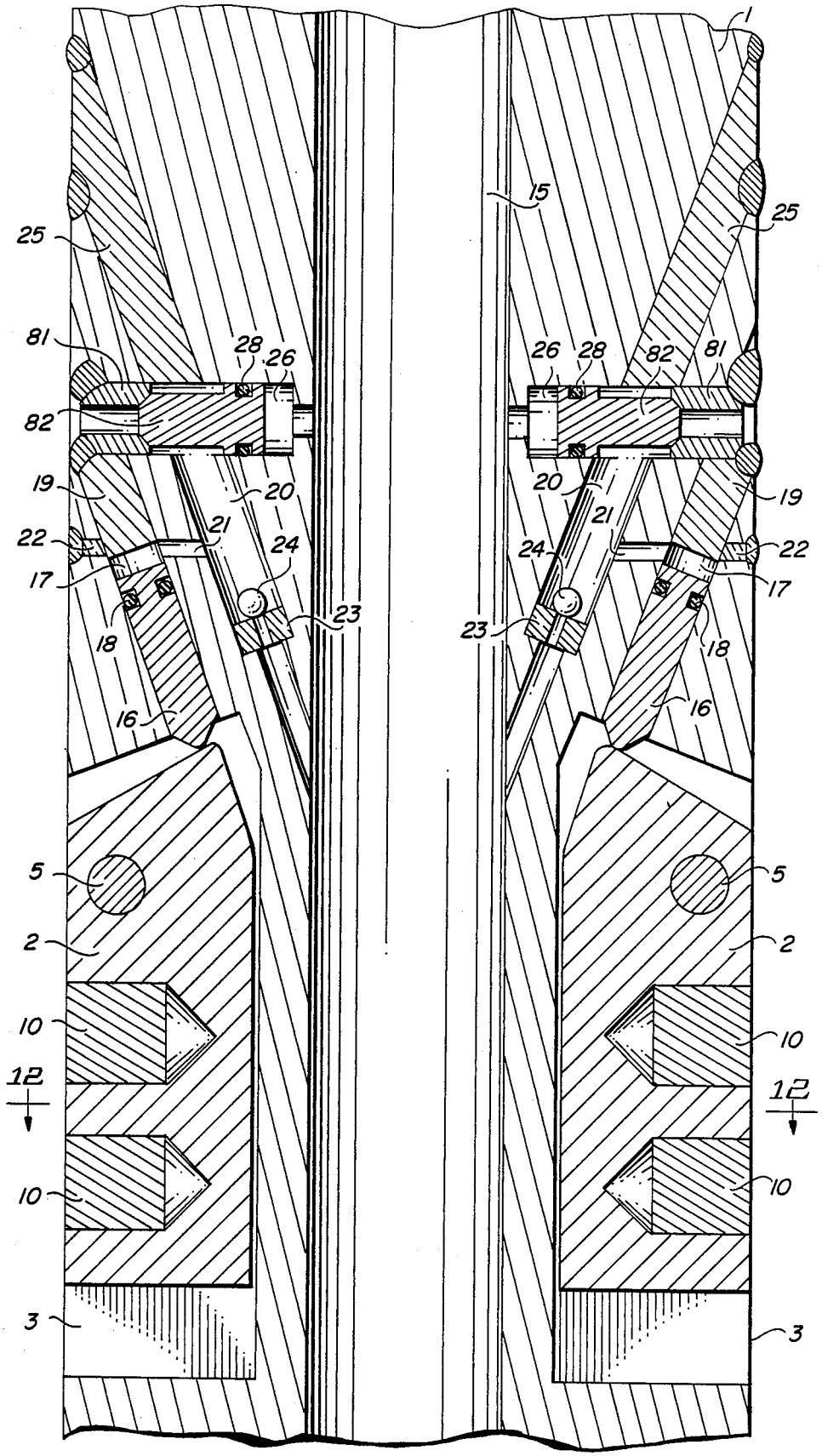
FIG. 11 is a longitudinal, sectional view of a fifth embodiment of the invention.

Specifically referring to FIGS. 11 and 12 of the drawings, the fifth embodiment comprises a plurality of radially movable shoes 2 disposed within corresponding slots 3 in the sides of the body 1. The slots 3 do not extend through the sides of the body 1 and therefore are spaced from the axial bore 15 of the body 1. Each of the shoes 2 is retained in the illustrated position by a pivot 5 which permits the shoes 2 to swing radially outward relative to the body 1. The upper ends of the shoes 2 are each shaped for suitable engagement with corresponding pistons 16 so that the movement of pistons 16 can be utilized to pivot the shoes 2 outward. The pistons 16 are reciprocatingly received in a slidable manner within cylinders 17. The cylinders 17 are bored at suitable angles at a downward and inward angle respective to the axis of the body 1, with the angle and location of each cylinder 17 arranged to facilitate effectual contact between the pistons 16 and the respective shoes 2. The upper outer ends of the cylinders 17 are each closed off by means of a suitable plug 19 which may be fastened and sealed by welding. The pistons 16 are each reciprocatingly sealed respective to the cylinders 17 by o-rings 18.

Corresponding manifold passages 20, located above and generally parallel to each cylinder 17, are bored from the outside of body 1 in a downward and inward angle through the side of the body 1 to intersect the inner axial bore 15 of the body 1. Each manifold 20 is thus arranged to provide fluid communication between the axial bore 15 and the manifolds 20. Corresponding connecting passages 21, bored from the outside of the body 1, is directed inward to intersect both the respective cylinders 17 and the respective manifold 20, and are arranged to provide fluid communication between the manifolds 20 and the cylinders 17. The outer extremity of each connecting passage 21 is closed off by means of a plug 22 which is fastened and sealed by welding. A shoulder is provided near the lower marginal extremity of each manifold 20 for nesting of a corresponding valve seat 23 and ball check valve 24, with the ball check valve 24 arranged to permit fluid to pass upward into the manifold 20 while preventing fluid from passing downward out of the manifold 20. The upper end of each manifold 20 is closed off by means of a plug 25 which is fastened and sealed by welding.

Corresponding fluid control ports 26, located below each respective plug 25 and above each respective connecting passage 21, are bored inward from the outside of the body 1 to intersect each respective manifold 20 and the inner axial bore 15, thus providing fluid communication with the axial bore 15, the manifolds 20 and the outside of the body 1. A blocking valve 82 is installed in each port 26 and movably sealed thereto by o-rings 28 near the inner marginal end of the blocking valve 82. The outer end of each blocking valve 82 is shaped to nest and seal against a valve seat 81, which is fastened and sealed in the outer end of each port 26. Each valve seat 81 has a fluid passage therethrough for venting of fluid to the outside of the body 1. The outer end of each blocking valve 82 has a smaller diameter than the inner sealed end, to provide differential diameters and to permit fluid passage therearound. A shoulder is provided near the inner marginal extremity of each port 26 to limit the inward travel of the blocking valves 82. The outward travel of the blocking valves 82 is limited by the valve seats 81.

In the operation of the embodiment of FIG. 11, pressurized fluid within the axial bore 15 will enter the manifolds 20 through the check valves 24 and also enter the cylinders 17 through the connecting passages 21. Also, the pressurized fluid within the axial bore 15 will enter the inner end of the ports 26 and force the blocking valves 82 outward against the valve seats 81, blocking any escape of fluid from the port end of the manifolds 20. Thus, the pressurized fluid forces the pistons 16 downward against the shoes 2 which are in turn caused to swing outward into abutment with the wall of the borehole. As fluid pressure is maintained, the shoes will be held against the wall of the borehole. The shoes will be progressively moved against the borehole wall as wear occurs on the outer surfaces of the shoes 2. Furthermore, as fluid pressure is maintained, the blocking valves 82 and the ball check valves 24 will prevent any escape of fluid from the manifolds 20 or the cylinders 17 so that upward travel of the pistons 16 and thus the inward travel of the shoes 2 is blocked.

Therefore, the body 1 is prevented from radially vibrating or whipping. When pressure is removed from within the axial bore 15, the blocking valves 82 are permitted to move inward away from the valve seats 81, thereby venting fluid and permitting the pistons 16 to retract upward and the shoes 2 to retract inward.

The outer surfaces of each of the shoes 2 in each of the embodiments are preferably made wear resistant by the usual installation of tungsten carbide buttons 10 or by other suitable means.

It is known that the coefficient of friction between two coacting surfaces varies with the roughness and the composition of the surfaces. These factors are considered in selecting the material of construction of the above two coacting surfaces of the wedge and stabilizer body.

The slope of the angle formed between the sliding surfaces of the wedge and the direction of the force against the wedge faces; and, the angle formed between the sliding surfaces and the axis of the piston must be considered and judiciously selected in order to achieve an optimum range of values which provides suitable blocking action of the stabilizer.

I claim:

1. A drill bit stabilizer comprising; a main body having a central axis, means by which the upper end of said main body can be attached to a driving means; means at a lower end of said main body forming a drill bit; a throat formed through said main body for passage of drilling fluid therethrough and to the face of a bit that may be attached thereto;

means forming an inclined slide surface on said main body, radially active stabilizing means slidably and guidably mounted to said inclined slide surface for radially stabilizing said main body relative to a borehole;

a plunger; means by which said plunger is arranged diagonally relative to the central axis of said main body; said plunger being positioned in said main body for engaging and applying an outward directed force on said radially active stabilizing means to thereby move said radially active stabilizing means into any one of a range of different extended positions;

and blocking means including and radially active stabilizing means and said inclined slide surface for frictional interaction with one another to selectively prevent inward radial movement of said radially active stabilizing means from any of said extended positions upon application of a radially directed force on said main body that is opposed to outward movement of said radially active stabilizing means sufficient to displace said outward force.

2. A drill bit stabilizer as recited in claim 1 wherein said radially active stabilizing means includes a wedge means installed in said main body and arranged to be forced outward by said plunger into abutment with the wall of a borehole.

3. A drill bit stabilizer as recited in claim 2 wherein said wedge means and said inclined slide surface slide against each other, said inclined slide surface is positioned at an angle respective to the central axis of the main body such that an inward radial force exerted upon said wedge means provides a resultant friction between said inclined slide surface and said wedge means that exceeds a resultant sliding vector force.

4. A drill bit stabilizer as set forth in claim 2 wherein said plunger includes means by which it is connected to said wedge means to restrain said wedge means towards said main body.

5. A drill bit stabilizer as recited in claim 1 wherein said plunger includes a biasing means for exerting a force thereon.

6. A drill bit stabilizer as recited in claim 2 wherein said plunger is hydraulically actuated radially outward by hydraulic pressure that may be effected in the throat.

7. A drill bit stabilizer as set forth in claim 1 wherein a springing means is enclosed within a sealed chamber, said spring means contained within said sealed chamber biasing said plunger radially outwardly.

8. A drill bit stabilizer as set forth in claim 1 wherein said inclined slide surface is located in a plane that passes through the central axis and is positioned at a diagonal angle which extends downward and outward relative to the said main body.

9. A drill bit stabilizer as set forth in claim 1 wherein the lower marginal end of said main body is made into a drill bit having a drilling face formed at the lower terminal end thereof.

10. A drill bit stabilizer as claimed in claim 1 wherein a plurality of said radially active stabilizing means are positioned radially about the central axis of said main body generally on a common plane arranged perpendicular to said central axis of said main body.

11. A drill bit stabilizer as presented in claim 1 wherein said inclined slide surface is fixed with respect to said main body.

12. A drill bit stabilizer as presented in claim 1 wherein the said main body contains secondary gauge cutter means positioned above said stabilizing means.

13. A drill bit stabilizer having a main body and a longitudinal central axis, means by which said main body can be connected into a drill string; means at a lower end of said main body for accommodating a drill bit having a face at the lower end thereof; a throat formed through said main body for passage of drilling fluid therethrough and to the face of a bit; a plurality of stabilizing means mounted circumferentially about said main body for radially stabilizing said main body relative to a borehole; said stabilizing means having a longitudinal side and a radial length, said stabilizing means being mounted for radial movement respective to said main body; means including a hydraulically responsive plunger arranged for applying outward force on said stabilizing means and thereby moving said stabilizing means radially outward into any one of a range of different extended positions; and blocking means for selectively preventing inward radial movement of said stabilizing means from any of said extended positions upon application of inward radial force upon said stabilizing means sufficient to displace said outward force, said blocking means includes means forming an inclined slide surface in said main body for frictional interaction with said stabilizing means, said longitudinal side of said stabilizing means slides along said inclined slide surface, the radial length of said stabilizing means is less than the radius of said main body.

14. A drill bit stabilizer as presented in claim 13 wherein the said main body contains secondary gauge cutters positioned sequentially behind said stabilizing means.

15. A drill bit stabilizer as recited in claim 13 wherein said stabilizing means includes a wedge means installed for slidable movement in said main body and arranged to be forced outward into abutment with the wall of a borehole.

16. The stabilizer of claim 15 wherein said wedge means and said inclined slide surface slide against each other, said inclined slide surface is positioned at an angle respective to the central axis of the main body such that an inward radial force exerted upon said wedge means provides a resultant friction between said inclined slide surface and said wedge means that exceeds a resultant sliding vector force.

17. The stabilizer of claim 13 wherein said means for applying an outward force includes a spring for exerting an outward force upon said stabilizing means.

18. The stabilizer of claim 17 wherein said spring is enclosed in a sealed chamber.

19. In a borehole forming operation wherein a drill string extends downhole to a drill bit and rotates the drill bit while drilling fluid flows down the drill string to the drill bit for circulating cuttings up the borehole annulus, the method of radially stabilizing the rotating drill string comprising the steps of:

mounting radially active stabilizing means circumferentially about part of the drill string to abut the borehole at a location near said drill bit; making the radial length of said stabilizing means less than the radius of said drill string; forming a throat along the central axis of said part of said drill string;

applying outward force upon said radially active stabilizing means by effecting the pressure differential of the drilling fluid contained with the throat and the borehole annulus, and thereby moving said radially active stabilizing means into any one of a range of different extended positions;

selectively preventing inward radial movement of said radially active stabilizing means from any one of said range of different extended positions by arranging an inclined slide surface diagonally downward and outward relative to the central axis for frictional interaction with said radially active stabilizing means between said drill string at said location and a longitudinal side of said radially active stabilizing means.

20. The method of claim 19 and additionally providing a spring for tension upon said radially active stabilizing means.

21. The method of claim 20 and further including the steps of:

applying outward force by hydraulically moving a plunger against said radially active stabilizing means, thereby forcing the radially active stabilizing means to engage the wall surface of the borehole and stabilize the rotating drill string.

22. The method of claim 19 and further including the step of providing secondary gauge cutters on the said drill string positioned sequentially behind the said radially active stabilizing means.

23. In a rotary drill string having a drill bit attached thereto for forming a borehole and an axial passageway through which drilling fluid flows to the bit face, the combination with said drill string of a drill bit stabilizer;

said stabilizer includes a main body and means at an upper end thereof for attachment to said drill string; means at a lower end of said main body for attachment to said drill bit; a throat formed through said main body for passage of drilling fluid therethrough; radially active stabilizing means mounted for movement to said main body for radial extension therefrom for radially stabilizing said main body relative to the borehole; and radially active stabilizing means being installed in said main body and arranged to be forced outward to any one of a range of different extended positions into abutment with the wall of a borehole; and blocking means including said radially active stabilizing means and an inclined slide surface for frictional interaction with one another to selectively prevent inward radial movement of said radially active stabilizing means from any of said extended positions upon application of a radially directed force on said main body that is opposed to outward movement of said radially active stabilizing means sufficient to displace said outward force; and secondary gauge cutters are mounted to said main body sequentially behind said radially active stabilizing means.

24. A drill bit stabilizer as recited in claim 23 wherein a spring actuated plunger is included, said spring actuated plunger is arranged for directing force onto and moving said radially active stabilizing means inwardly in the absence of hydraulic pressure.

25. A drilll bit stabilizer as recited in claim 23 wherein a spring is included for exerting an outward force on said radially active stabilizing means.

* * * * *